US005485359A

United States Patent [19]

Galvin

[11] Patent Number: 5,485,359

[45] Date of Patent: Jan. 16, 1996

[54] REMOTE CONTROL HOLDER AND ILLUMINATOR

[76] Inventor: William J. Galvin, 7 E. 10th St., Brooklyn, N.Y. 11218

[21] Appl. No.: 224,678

[22] Filed: Apr. 7, 1994

[51] Int. Cl.[6] ..... F22V 33/00

[52] U.S. Cl. ..... 362/109; 362/85; 362/284

[58] Field of Search ..... 362/85, 98, 99, 362/109, 269, 271, 274, 282, 284, 370, 371, 382, 277

[56] References Cited

U.S. PATENT DOCUMENTS

| | | | |
|---|---|---|---|
| 1,889,373 | 11/1932 | Pereira | 362/99 |
| 2,749,430 | 6/1956 | Cohn | 362/98 |
| 4,388,678 | 6/1983 | Turner | 362/98 |
| 5,115,383 | 5/1992 | Lee | 362/109 |
| 5,122,937 | 6/1992 | Stoudemire | 362/109 |
| 5,172,974 | 12/1992 | Riban | 362/109 |
| 5,183,325 | 2/1993 | Hurdle | 362/109 |
| 5,188,448 | 2/1993 | Siriani et al. | 362/109 |
| 5,203,622 | 4/1993 | Sottile | 362/109 |
| 5,379,201 | 1/1995 | Friedman | 362/253 |

*Primary Examiner*—Ira S. Lazarus
*Assistant Examiner*—Y. Quach
*Attorney, Agent, or Firm*—David L. Baker; Henry S. Miller; Rhodes & Ascolillo

[57] ABSTRACT

A remote control holder and illumination device, for a remote control having a keypad has a base, an illumination member and a mirror housing adjustment member. The base has a guide passage therein. A fastening member is attached to the upper surface of the base to fasten the base to the remote control. The illumination member has a support frame slidingly attached to the base. A mirror housing is connected to the support frame. A convex mirror is attached to the mirror housing. The mirror may be curved in a convex or concave manner. A mirror housing adjustment member has a guide tab, connected to the support frame, that traverses the guide passage. An actuation member extends through the guide passage to allow the user to adjust the position of the mirror housing along the length of the base.

4 Claims, 2 Drawing Sheets

REMOTE CONTROL HOLDER AND ILLUMINATOR

BACKGROUND OF THE INVENTION

1. Field of the Invention

This invention relates, in general, to a device to hold and illuminate a remote control for an electronic apparatus such as a television or a VCR and, in particular, to a remote control holder that is illuminated by utilizing the ambient light from a light source such as the television.

2. Description of the Related Art

Many remote control holders and/or illuminators have been developed since remote controlled electronic devices have become popular. However, the holders that provided illumination required a power circuit including a light and one or more batteries.

U.S. Pat. No. 5,122,937 to T. L. Stoudemire on Jun. 16, 1992 for a Remote Control Holder and Illuminator describes a wedge-shaped holder having a chamber to contain batteries and a goose-necked flexible lamp to illuminate the keys of the remote control placed on the top surface of the holder.

U.S. Pat. No. 5,172,974 to R. C. Riban on Dec. 22, 1992 for an Illumination Device shows a goose-neck lamp to illuminate the keys of a remote control. The lamp has a battery base supporting the lamp that is adhered to the bottom surface of a remote control.

U.S. Pat. No. 5,183,325 to T. D. Hurdle on Feb. 02, 1993 for an Illumination Apparatus for Remote Control Device describes a lamp having a bracket attached to a bottom of a remote control. The remote control is tilted, a gravity switch turns on the light and illuminates the keys of the remote control.

U.S. Pat. No. 5,188,448 to Anita Siriani, et al., on Feb. 23, 1993 for a TV, VCR, Stereo, CD Night Light shows a platform having a short open-ended housing thereon into which is inserted a portion of a remote control. The housing has a battery chamber and a light to illuminate the remote control keyboard.

U.S. Pat. No. 5,203,622 to K. Sottile on Apr. 20, 1993 for a Remote Control Lighting Unit describes a small support base containing batteries and having a flexible-necked light attached thereto.

The present invention does not require a power circuit and requires no batteries to illuminate the keypad of the remote control. It is thereby more cost efficient and environmentally sound.

SUMMARY OF THE INVENTION

One of the problems encountered by remote control users is that the remote controls are usually operated in a low light environment. In low light conditions, it is often difficult to determine which key to press. Turning on a light in the room is not always a convenient or popular option. This problem is solved in a unique manner without utilizing the commonly found battery-operated light bulb and switch circuit found in other holders. The mirror used in the present invention is a magnifying mirror (i.e., concave) which spreads the light striking its surface and projects that reflected light onto the surface of the keyboard.

In a first aspect of the present invention, a remote control holder and illumination device for a remote control having a keypad is shown. The remote control holder and illumination device has a base, an illumination member and a mirror housing adjustment member. The base has a guide passage therein. There is an upper surface on the base. The illumination member has a support frame attached to the base. A mirror housing is connected to the support frame. A mirror is attached to the mirror housing. The mirror may be curved in a concave manner. A mirror housing adjustment member has a guide tab, connected to the support frame, that traverses the guide passage. There is an actuation member extending through the guide passage to allow the user to adjust the position of the mirror housing along the length of the base. A fastener may be attached to the base top.

In a second aspect of the present invention, a remote control holder and illumination device for a remote control having a keypad is shown. The remote control holder and illumination device has base, an illumination member and a mirror housing adjustment member. The base has a first guide passage and a second guide passage therein. There is a third guide passage in the base open to the first guide passage and open to the second guide passage. A first guide port extends from the first guide passage through a first side wall of the base. A second guide port extends from the second guide passage through a second side wall of the base. There is an upper surface on the base. A releasable fastening member is attached to the upper surface of the base to removably fasten the base to the remote control. The illumination member has a first and a second support frame removably attached to the base. There is a mirror housing pivotally connected to the first and second support frame. The mirror housing adjustment member has a first guide tab connected to the first support frame. The first guide tab traverses the first guide port. There is a second guide tab connected to the second support frame. The second guide tab traverses the second guide port. There is an actuation member extending through the first guide port, the first guide passage, the third guide passage, the second guide passage and the second guide port.

It is an object of this invention to provide a remote control holder and illumination device that does not require a battery and a switched light circuit to illuminate the keypad of a remote control.

DESCRIPTION OF THE PREFERRED EMBODIMENTS

Figure 1:
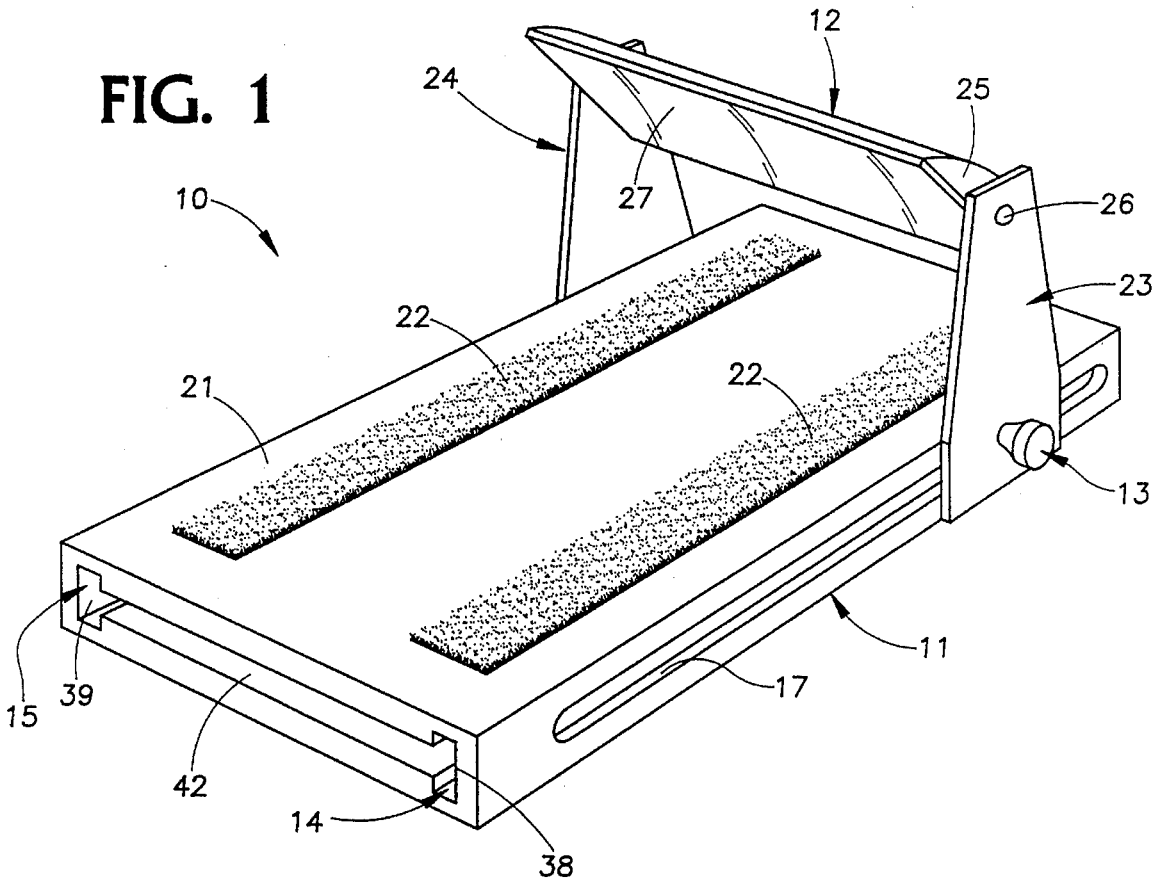
FIG. 1 is a perspective view of the Remote Control Holder and Illuminator.
Figure 2:
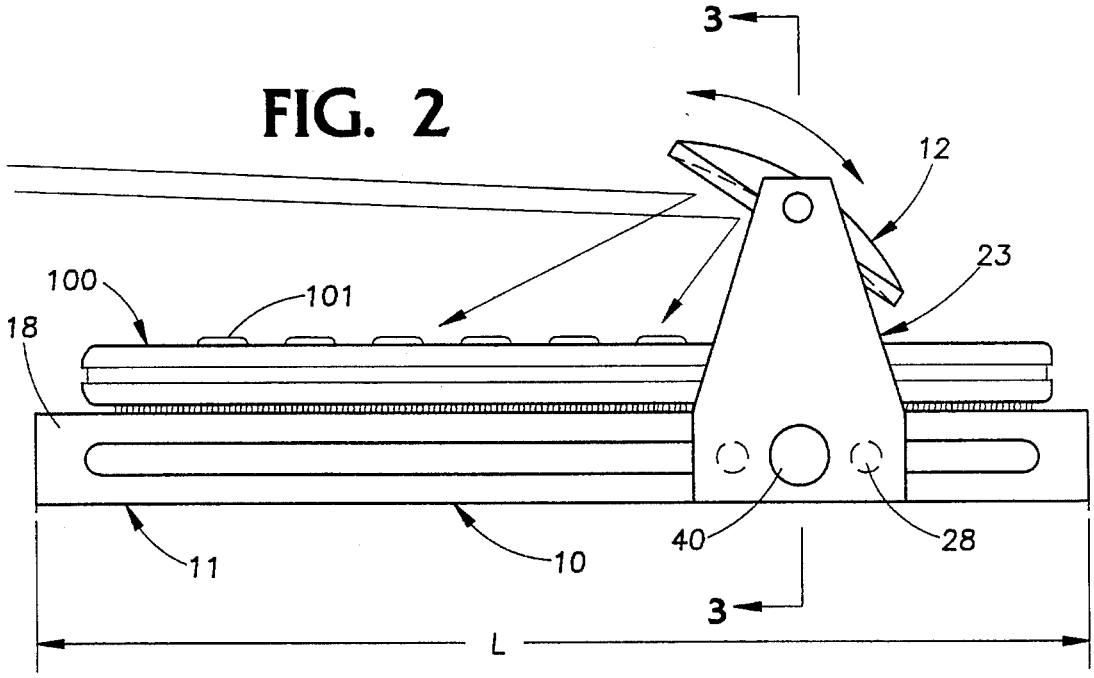
FIG. 2 is a left side elevational view. The arrowed lines show the path of ambient light striking the mirrored surface and being magnified (expanded) and reflected on the key surface of the remote control.
Figure 3:
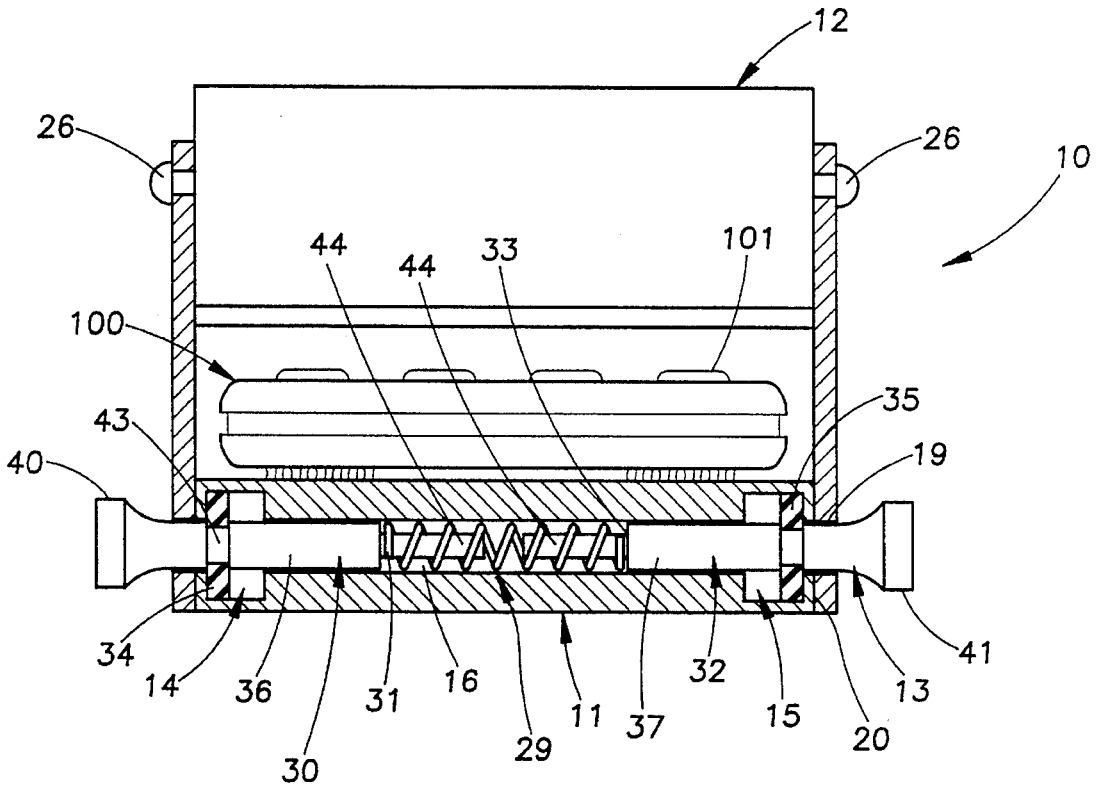
FIG. 3 is a cross-sectional view taken along lines 3—3 of FIG. 2.
Figure 4:
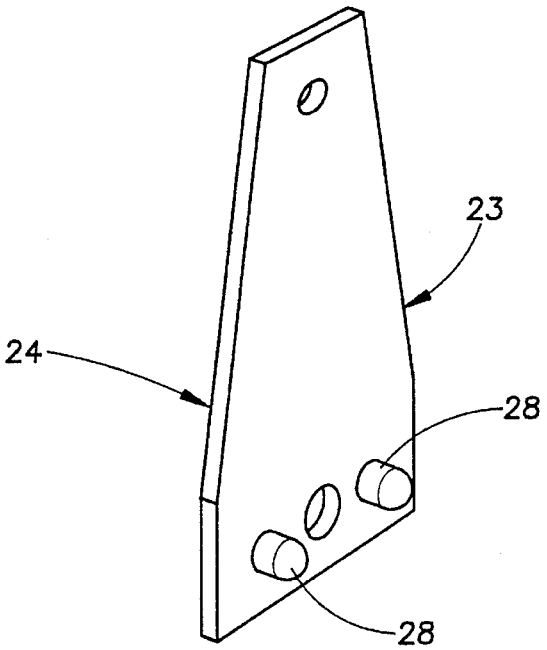
FIG. 4 is a perspective view of the support frames. The first and second support frames are a mirror image of each other.

Referring to FIGS. 1 through 4, a remote control holder and illumination device 10, for a remote control 100 having a keypad 101, is shown and described that has a base 11, an illumination member 12 and a mirror housing adjustment member 13. The base 11 has a first guide passage 14 and a second guide passage 15 within the base. There is a third guide passage 16 in the base 11 open to the first guide passage 14 and also open to the second guide passage 15. A first guide port 17 extends from the first guide passage 14 through a first side wall 18 of the base. A second guide port 19 (shown in FIG. 3 with the shaft of the second actuation member passing through it) extends from the second guide passage 15 through a second side wall 20 of the base 11. The first guide port 17 and the second guide port 19 extend substantially along the length L of the base 11. There is an upper surface 21 on the base 11. A releasable fastening member 22 (such as is a double-sided adhesive or a hook and loop fastener) is attached to the upper surface 21 of the base 11 to removably fasten the base 11 to the remote control 100.

The illumination member 12 has a first support frame 23 and a second support frame 24 removably attached to the base 11. A mirror housing 25 is pivotally connected (by pin 26) to the first support frame 23 and pivotally connected (by pin 26) to the second support frame 24. There is a mirror 27 attached to the mirror housing 25 to reflect ambient light usually from the TV (light is shown by arrows in FIG. 2) onto the remote control keyboard 101. The light reflected by the mirror 27 can be directed to different portions of the keyboard 101 by grasping the mirror housing 25 and turning the mirror housing 25 on its pivots (pins 26). The mirror 27 is preferably concave in shape.

The mirror housing adjustment member 13 has a first guide tab 28 that is connected to the first support frame 23. Preferably there are two first guide tabs 28 to guide and stabilize the first support frame 23 along the first guide port 17. The first guide tabs 28 slidingly traverse back and forth in the first guide port 17. The mirror housing adjustment member 13 has a second guide tab 28 that is connected to the second support frame 24. The first support frame 23 and the second support frame 24 are a mirror image of each other and similar elements will have similar reference numbers. Preferably there are two second guide tabs 28 to guide and stabilize the second support frame 24 along the second guide port 19. The second guide tabs 28 slidingly traverse back and forth in the second guide port 19. There is a spring 29 within the third guide passage 16. A first actuation member 30 extends through the first guide port 17, through the first guide passage 14 and into the third guide passage 16 and abuts an end 31 of the spring 29. A second actuation member 32 extends through the second guide port 19, through the second guide passage 15 and into the third guide passage 16 and abuts another end 33 of the spring 29. The spring 29 biases the first actuation member 30 and the second actuation member 32 away from each other. There is a first retaining member 34, on the first actuation member 30, within the first guide passage 14. There is a second retaining member 35, on the second actuation member 32, within the second guide passage 15. The retaining members may be a disk having a hole therein to receive the actuation members. The retaining members may be made of a resilient material and tightly grasp the outer perimeters of reduced diameter 43 on shafts 36 and 37 of the actuation members 30 and 32, respectively. The spring 29 biases the first retaining member 34 into abutment with a wall 38 of the first guide passage 14. The spring 29 also biases the second retaining member 35 into abutment with a wall 39 of the second guide passage 15. There is a spring retaining pin 44 on an end of each shaft 36 and 37 of the actuation members 30 and 32.

In operation, a two-part fastener 22 such as a hook and loop fastener can be used to releasably attach the remote control 100 to the upper surface 21 of the base 11. One part of the fastener would be adhered to the bottom surface of the remote control and one part of the fastener 22 would be adhered to the top surface 21 of the base 11. The mirror inclination (direction shown by a curved line and arrows in FIG. 2) can be adjusted by turning the mirror housing 25, on its pivot points on the frame supports 23 and 24, to the desired angle. The light projecting from the TV (shown by straight; lines and arrows in FIG. 2) is used to illuminate the keypad 101. The support flames 23 and 24 may be moved up and down the length L of the base 11 to better illuminate a desired portion of the keypad 11.

The actuation members 30 and 32 (part of the mirror housing adjustment member 13) have a knob 40 and 41 with an elongated shaft 36 and 37 that are spring-biased to a locked position and are assisted in retaining their locked position by resilient retaining disks 34 and 35 whose surfaces supply sufficient resistance to slippage to reduce the chance of undesired slippage of the frame supports 23 and 24 to an unselected position on the base 11. When the actuation members 30 and 32 are pushed in toward the center of the base 11, the retaining disks 34 and 35 are pushed away from the walls 38 and 39 of the first and second guide passages 14 and 15. The actuation members are free to move within the guide ports, the first, second and third guide passages and allow the mirror housing adjustment member 13 to be moved to a selected point on the base 11. The assembly of the mirror housing adjustment member 13 may be assisted by utilizing the end port 42 which allows access to the first guide passage, the second guide passage and the third guide passage.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A remote control holder and illumination device, for a remote control having a keypad, comprising:

(a) a base comprising:
at least a guide passage in the base; including an upper surface, a lower surface and a plurality of sides; and (b) an illumination member comprising:
at least a support frame attached to the base; through at least one actuation member
a mirror housing connected to the support frame; and
a mirror attached to the mirror housing; and (c) a mirror housing adjustment member comprising:
a guide tab, connected to the support frame, traversing the guide passage; and
said actuation member, slidingly engaged within the guide passage, extending through the guide passage and connected to the support frame.

2. A remote control holder and illumination device, for a remote control having a keypad, comprising:

(a) a base comprising:
a first guide passage in the base;
a second guide passage in the base;
a third guide passage in the base open to the first guide passage and open to the second guide passage;
a first guide port extending from the first guide passage through a first side wall of the base;
a second guide port extending from the second guide passage through a second side wall of the base;
an upper and lower surface on the base; and
a fastening member attached to the upper surface of the base to fasten the base to the remote control;

(b) an illumination member comprising:
a first support frame removably attached to the base;
a second support frame removably attached to the base;
a mirror housing pivotally connected to the first support frame and to the second support frame; and (c) a mirror housing adjustment member comprising:

a first guide tab, connected to the first support frame, traversing the first guide port;

a second guide tab, connected to the second support frame, traversing the second guide port; and a first and second actuation members extending through the first guide port, the first guide passage, the third guide passage, the second guide passage and the second guide port.

3. A remote control holder and illumination device, for a remote control having a keypad, comprising:

(a) a base comprising:

a first guide passage in the base;

a second guide passage in the base;

a third guide passage in the base open to the first guide passage and open to the second guide passage;

a first guide port extending from the first guide passage through a first side wall of the base;

a second guide port extending from the second guide passage through a second side wall of the base;

an upper and lower surface on the base; and a releasable fastening member attached to the upper surface of the base to removably fasten the base to the remote control;

(b) an illumination member comprising:

a first support frame removably attached to the base;

a second support frame removably attached to the base;

a mirror housing pivotally connected to the first support frame and to the second support frame; and a mirror attached to the mirror housing; and (c) a mirror housing adjustment member comprising:

a first guide tab, connected to the first support frame, traversing the first guide port; a second guide tab, connected to the second support frame, traversing the second guide port;

a spring within the third guide passage;

a first actuation member, extending through the first guide port and the first guide passage and into the third guide passage, abutting an end of the spring;

a second actuation member, extending through the second guide port and the second guide passage and into the third guide passage, abutting another end of the spring;

a first retaining member, on the first actuation member, within the first guide passage;

a second retaining member, on the second actuation member, within the second guide passage;

the spring biasing the first retaining member into abutment with a wall of the first guide passage; and the spring biasing the second retaining member into abutment with a wall of the second guide passage.

4. A remote control holder and illumination device as described in claim 3 wherein the mirror is concave-shaped.

* * * * *